US011668318B2

(12) United States Patent
Xu et al.

(10) Patent No.: US 11,668,318 B2
(45) Date of Patent: Jun. 6, 2023

(54) BLADE STRUCTURE WITH MULTIPLE BLADE ANGLES AND HEAT DISSIPATION DEVICE

(71) Applicant: VAST GLORY ELECTRONICS & HARDWARE & PLASTIC(HUI ZHOU) LTD., Hui Zou (CN)

(72) Inventors: Shi Man Xu, Hui Zhou (CN); Chun-Hsien Chen, Hui Zhou (CN)

(73) Assignee: VAST GLORY ELECTRONICS & HARDWARE & PLASTIC(HUI ZHOU) LTD., Hui Zhou (CN)

( * ) Notice: Subject to any disclaimer, the term of this patent is extended or adjusted under 35 U.S.C. 154(b) by 0 days.

(21) Appl. No.: 17/177,989

(22) Filed: Feb. 17, 2021

(65) Prior Publication Data

US 2022/0205453 A1 Jun. 30, 2022

(30) Foreign Application Priority Data

Dec. 30, 2020 (CN) ..... 202011608914.8

(51) Int. Cl.
*F04D 29/38* (2006.01)
*F04D 25/08* (2006.01)
*F04D 29/34* (2006.01)

(52) U.S. Cl.
CPC ..... *F04D 29/384* (2013.01); *F04D 25/08* (2013.01); *F04D 29/34* (2013.01); *F04D 29/388* (2013.01); *F05D 2240/304* (2013.01)

(58) Field of Classification Search
CPC ..... F04D 29/384; F04D 29/38; F04D 29/388
See application file for complete search history.

(56) References Cited

U.S. PATENT DOCUMENTS

| | | | | |
|---|---|---|---|---|
| 4,687,416 | A * | 8/1987 | Spranger | B64C 11/16 416/200 R |
| 6,863,500 | B2 * | 3/2005 | Jung | F04D 29/384 415/218.1 |
| 8,550,781 | B2 * | 10/2013 | Zha | F04D 29/681 416/189 |
| 8,821,126 | B2 * | 9/2014 | Oleson | F04D 25/088 416/228 |
| 10,302,094 | B2 * | 5/2019 | Gomes | F04D 29/388 |
| 2018/0335045 | A1 * | 11/2018 | Sawada | F04D 29/38 |

* cited by examiner

*Primary Examiner* — Michael L Sehn
(74) *Attorney, Agent, or Firm* — Maschoff Brennan

(57) ABSTRACT

A blade structure with multiple blade angles and a heat dissipation device include: the blade structure consisting of a plurality of blades with different blade angles. The blade angles of the blades decrease from an inner side to an outer side along a longitudinal direction of the blade structure. The blades have top portions on the same surface and are integrally formed in one piece. A joint between the blades has a transition part. The blade structures are evenly mounted on the hub and are connected to an outer frame. The hub and the blade structures are integrally formed in one piece, or the hub, the blade structures, and the outer frame are integrally formed in one piece. The blade structures can guide air flow to reduce air shedding, suppress backflows, reduce vortex turbulence, increase air volume, improve heat dissipation efficiency, and reduce vortex noise and vibration.

12 Claims, 6 Drawing Sheets

BLADE STRUCTURE WITH MULTIPLE BLADE ANGLES AND HEAT DISSIPATION DEVICE

CROSS-REFERENCE TO RELATED APPLICATIONS

This non-provisional application claims priority under 35 U.S.C. § 119(a) on Patent Application No(s). 202011608914.8 filed in China, P.R.C. on Dec. 30, 2020, the entire contents of which are hereby incorporated by reference.

Technical Field

The present disclosure relates to a blade structure of a heat dissipation device, more particularly to a blade structure with multiple blade angles and a heat dissipation device including the same.

Background

As processing speed and performance of electronic devices such as central processing units increase, the electronic devices generate more heat during operation. The generated heat increases the temperature of the electronic device, and the reliability and performance of the electronic device will decrease if the heat is not efficiently dissipated out. In order to prevent overheating of the electronic device, a heat dissipation device such as a fan is used to efficiently dissipate heat generated by the electronic device. The airflow generated by the heat dissipation fan flows through a heating source for heat exchanging, dissipating the heat and thereby ensuring the desired operation of the electronic device.

A typical heat dissipation fan consists of a hub and several fan blades circumferentially around the hub, and the fan blades are evenly distributed and fixed on the fan hub along the circumferential direction thereof. During the operation of the heat dissipation fan, the fan blades are rotated by the fan hub so as to create an airflow from the ambient air, and the airflow theoretically goes in a direction parallel to the rotation axis of the fan. However, during the actual operation, the airflow that flows through the channels among the fan blades will be guided to flow in a direction not parallel to the rotation axis due to the shape of the fan blades, becoming relatively turbulent, such that the airflow easily becomes vortex shedding after crossing the fan blades. The generation of the vortex shedding will reduce the volume of air moved by the fan, resulting in a reduced volume of cooling air and thereby decreasing heat dissipation efficiency, meanwhile, accompanying with noise and vibration problems. As the speed of the heat dissipation fan increases, the vortex shedding, noise, and vibration become more obvious in the area closer to the outer side of the fan blades. Also, the speed of the fan has its limit. If the speed of the fan is too high, the lifespan of the fan will be shortened, thus increasing speed is not a practical solution to the above problems.

Accordingly, how to increase the air volume and avoid introducing turbulence without changing increasing speed is a problem needed to be solved, thus it is desirable to develop a blade structure that can overcome the abovementioned problems.

SUMMARY

The present disclosure provides a blade structure with multiple blade angles in order to solve the abovementioned technical problems.

According to one aspect of the present disclosure, a blade structure with multiple blade angles includes:

The blade structure consisting of a plurality of blades with different blade angles.

In the abovementioned blade structure, the blade angles of the plurality of blades decrease from an inner side to an outer side of the blade structure along a longitudinal direction of the blade structure.

In the abovementioned blade structure, the plurality of blades have top portions that are located on the same surface.

In the abovementioned blade structure, the plurality of blades are integrally formed in one piece.

In the abovementioned blade structure, a joint between the plurality of blades with the different blade angles has a transition part.

According to another aspect of the present disclosure, a heat dissipation device includes:

A hub; and

A plurality of blade structures that are evenly mounted (equally spaced around) on the hub and consist of a plurality of blades with different blade angles.

In the abovementioned heat dissipation device, the blade angles of the plurality of blades decrease from inner sides to outer sides of the plurality of blade structures along longitudinal directions of the plurality of blade structures.

In the abovementioned heat dissipation device, the plurality of blades of each of the plurality of blade structures are integrally formed in one piece.

In the abovementioned heat dissipation device, a joint between the plurality of blades with the different blade angles has a transition part.

In the abovementioned heat dissipation device, the abovementioned heat dissipation device further includes an outer frame, and the plurality of blades located at outermost sides of the plurality of blade structures are connected to the outer frame.

In the abovementioned heat dissipation device, the hub and the plurality of blade structures are integrally formed in one piece, or the hub, the plurality of blade structures, and the outer frame are integrally formed in one piece.

According to the blade structure with multiple blade angles and the heat dissipation device discussed above, through the design that the blade structure is a set of the blades with different blade angles, the blade structures can guide air flow in a way of multiple angles, multiple directions, and multiple gradations while rotating, reducing the air shedding occurred on the blade surfaces, suppressing backflow on the blade surfaces that flows in the opposite direction to the main air flows, reducing vortex turbulence in the flow field, increasing air volume, improving heat dissipation efficiency, and reducing vortex noise and vibration.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

Figure 1:
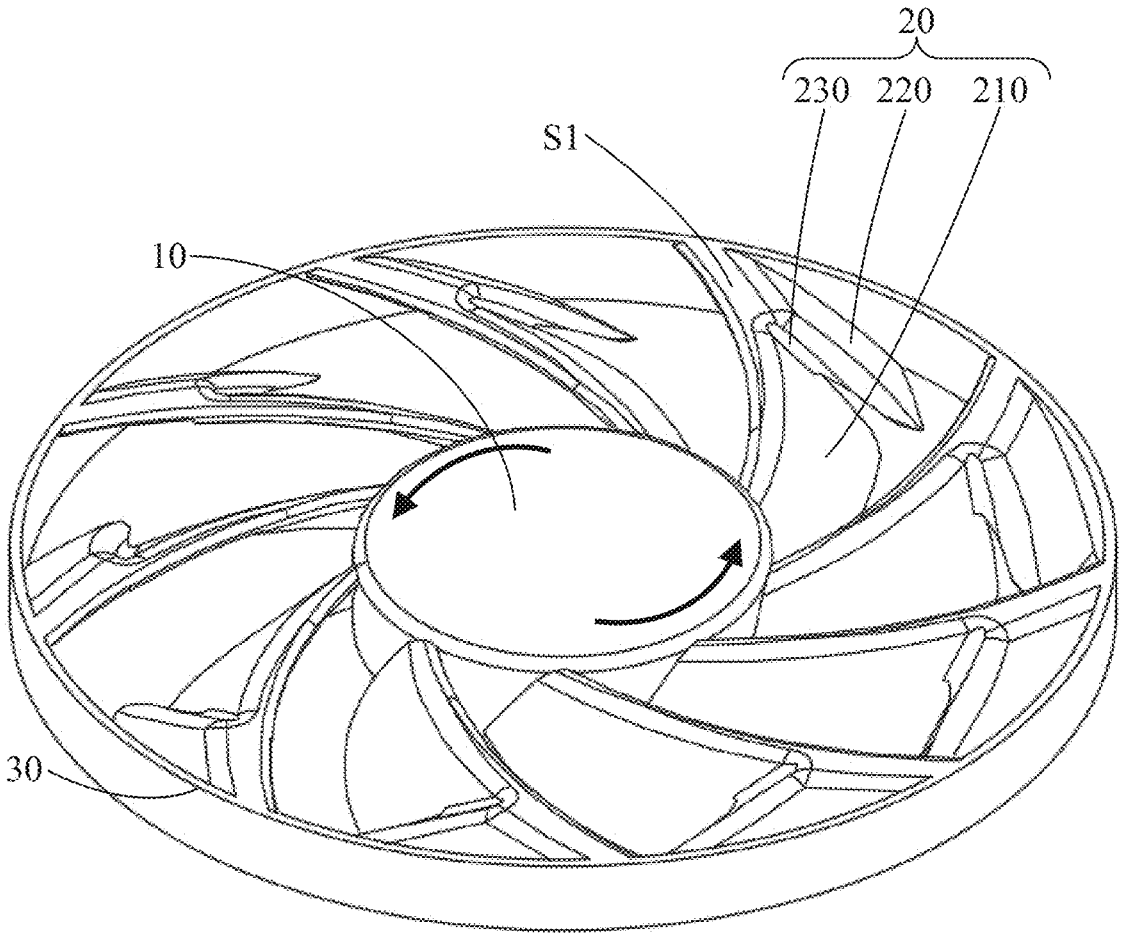
FIG. 1 is a perspective view of a blade structure with multiple blade angles and a heat dissipation device according to the present disclosure.

In order to make the purpose, the technical solutions, and the advantages of the embodiments of the present disclosure clearer, the technical solutions in the embodiments of the present disclosure will be clearly and completely described with reference to the accompanying drawings in the embodiments of the present disclosure. Obviously, the described embodiments are part of the embodiments of the present disclosure, rather than all the embodiments. All other embodiments that are based on the embodiments of the present disclosure and acquired by one skilled in the art without creative work should fall within the scope of the present disclosure.

The exemplary embodiments and the description thereof of the present disclosure are intended to explain the present disclosure rather than to restrict the present disclosure.

In addition, elements/components with the same or similar reference numerals in the accompanying drawing and the embodiments are used to represent the same or similar parts.

The terms about directions used in the specification, such as up, down, left, right, front, back, etc., are only used for describing the directions in the accompanying drawings. Therefore, these terms are used for easier description rather than restriction on the present disclosure.

The terms used in the specification, such as "include", "comprise", "have", "contain", etc., are open-ended terms and mean including but not limit to.

The term "and/or" used in the specification includes any one or combination of the components.

The terms "multiple" and "a plurality of" used in the specification include "two" and "two or more". The term "multiple groups" used in the specification includes "two groups" and "two or more groups".

Some terms used to describe the present disclosure will be discussed hereinafter or another place in the specification so as to provide one skilled in the art with additional guidance on the description of the present disclosure.

Please refer to FIG. 1, which is a perspective view of a blade structure with multiple blade angles and a heat dissipation device according to the present disclosure. As shown in FIG. 1, the blade structure with multiple blade angles and the heat dissipation device according to the present disclosure includes: a hub 10, a plurality of blade structures 20, a plurality of inner blades 210, a plurality of outer blades 220, a plurality of transition parts 230, a blade upper surface S1, an outer frame 30. Each of the blade structures 20 consists of one inner blade 210 and one outer blade 220 that have different blade angles. A top portion of the inner blade 210 and a top portion of the outer blade 220 of the same blade structure 20 are located on the same surface S1. The inner blade 210 and the outer blade 220 of each blade structure 20 are integrally formed in one piece, and a joint therebetween has a transition part 230. The plurality of blade structures 20 are evenly distributed on (equally spaced around) the hub 10, and the outer blades 220 of the blade structures 20 are connected to the outer frame 30. The hub 10 and the plurality of blade structures 20 are integrally formed in one piece, or the hub 10, the plurality of blade structures 20, and the outer frame 30 are integrally formed in one piece. The inner and outer blades share the same upper surface S1, such that the blade structure consisting of the inner and outer blades with different blade angles is more aesthetically pleasing and easily manufactured and can prevent personnel from being cut by the blade structure during manufacture, transportation, and assembly processes. The transition part 230 is to connect the inner blade to the outer blade, such that the transition between the inner and outer blades of different blade angles is a smooth surface.

Note that each blade structure of this embodiment includes the inner blade 210 and the outer blade 220, but the present disclosure is not limited thereto. In some embodiments, each blade structure may include three or more blades of different blade angles.

Figure 3:
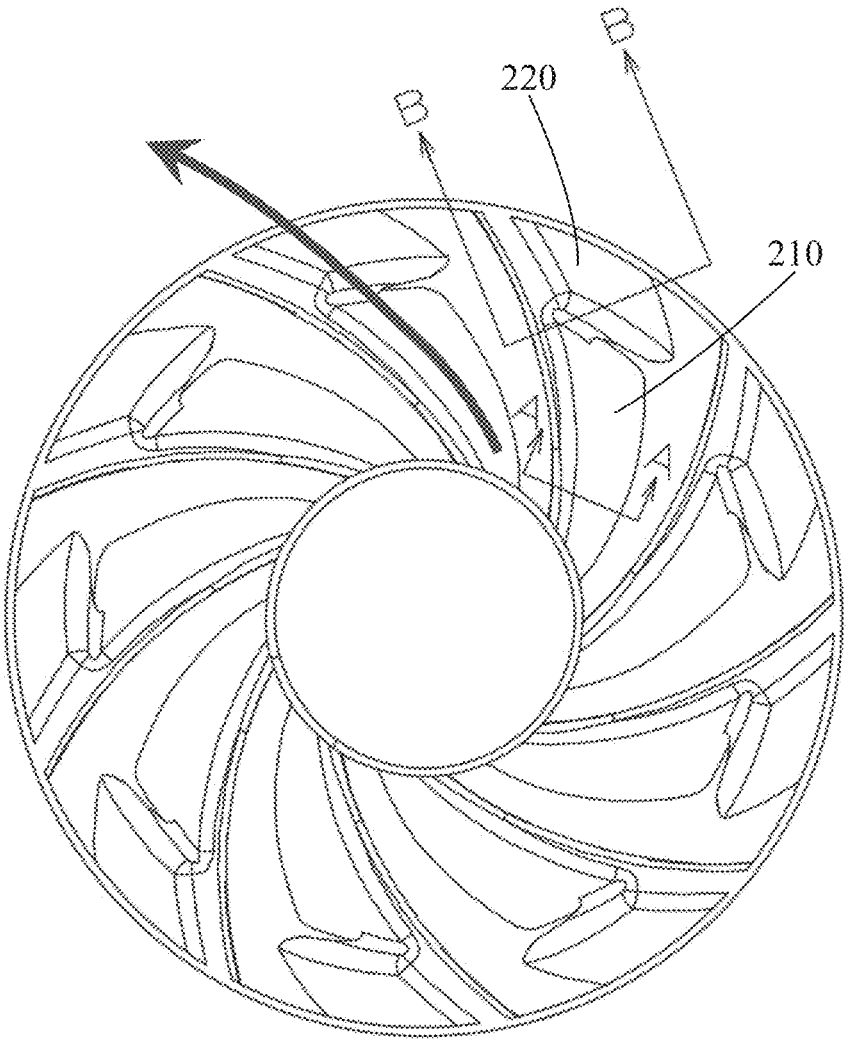
FIG. 3 is a top view of the blade structure with the multiple blade angles and the heat dissipation device according to the present disclosure.
Figure 4:
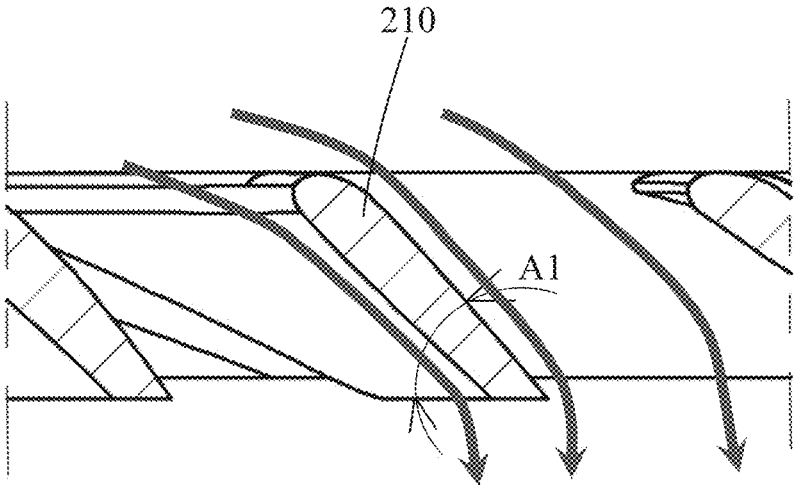
FIG. 4 is a cross-sectional view of an inner blade taken along line A-A in FIG. 3.
Figure 5:
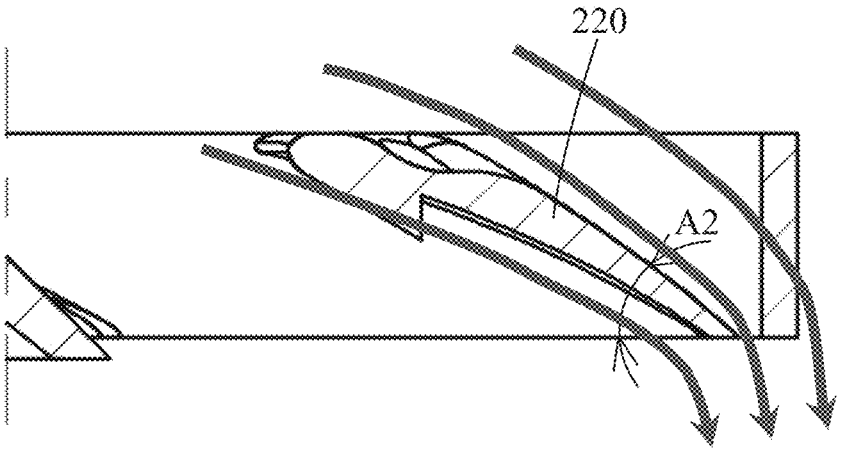
FIG. 5 is a cross-sectional view of an outer blade taken along line B-B in FIG. 3.

Please refer to FIG. 3 to FIG. 5, where FIG. 3 is a top view of the blade structure with the multiple blade angles and the heat dissipation device according to the present disclosure, FIG. 4 is a cross-sectional view of the inner blade 210 taken along line A-A in FIG. 3, and FIG. 5 is a cross-sectional view of the outer blade 220 taken along line B-B in FIG. 3. As shown in FIG. 3 to FIG. 5, A1 denotes the blade angle of the inner blade 210, A2 denotes the blade angle of the outer blade 220. The blade angle A1 of the inner blade 210 is larger than the blade angle A2 of the outer blade 220. That is, the blade angles of different blades decrease along longitudinal directions of the blade structures, and the direction indicated by the arrow in FIG. 3 represents the longitudinal direction of the blade structure.

Figure 2:
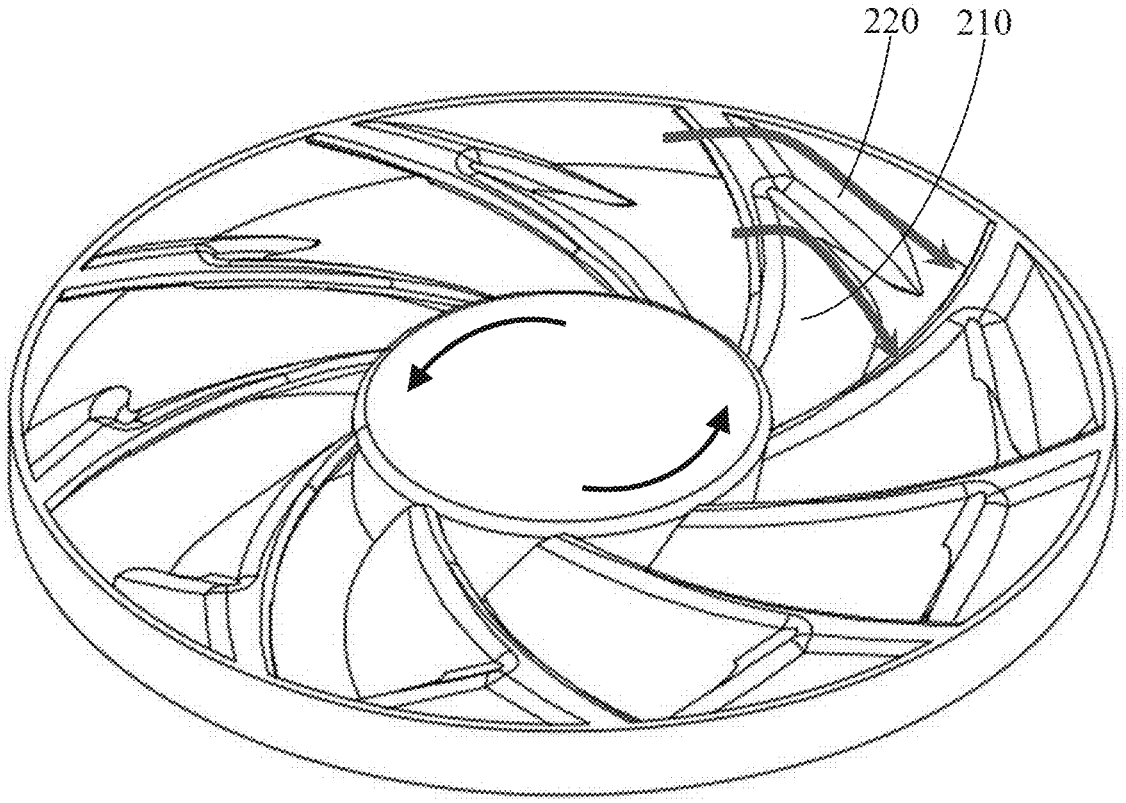
FIG. 2 is a schematic view showing air flows in the blade structure with the multiple blade angles and the heat dissipation device according to the present disclosure.

Please refer to FIG. 2, which is a schematic view showing air flows in the blade structure with the multiple blade angles and the heat dissipation device according to the present disclosure. The fluid dynamics regarding the blade structure are based on Bernoulli's principle. While the blade is rotating, the blade angles of the blade structure cause pressure difference between the upper side and the lower side of the blade, thereby a partial vacuum is formed above the blade. As such, the air above the blade is continuously drawn downwards and passing through the blade, generating a forced airflow and thereby achieving the delivery of cooling air. As shown in FIG. 2, FIG. 4, and FIG. 5, in the blade structure with multiple blade angles and the heat dissipation device, while the blade structures 20 is rotating, air above the blade structures 20 is drawn towards the lower side of the blade structures along the blades 210 and 220 of different blade angles. Since the blade angles A1 and A2 of the blades are different, air flows flowed by and guided by the blades can have multiple angles, multiple directions, and multiple gradations.

Figure 6:
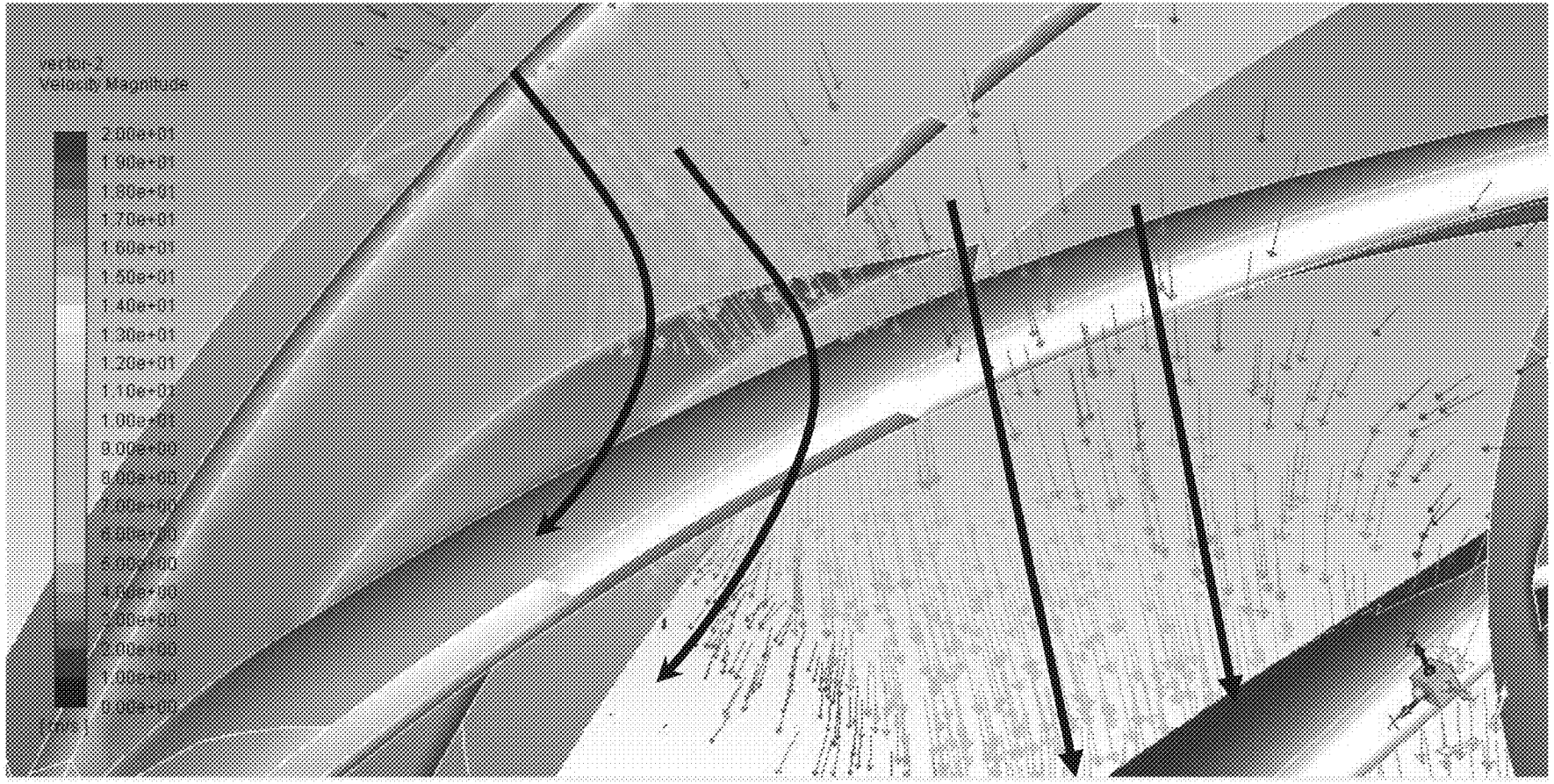
FIG. 6 is a schematic view showing a simulation analysis result of air flows in a model of the blade structure with the multiple blade angles and the heat dissipation device according to the present disclosure.
Figure 7:
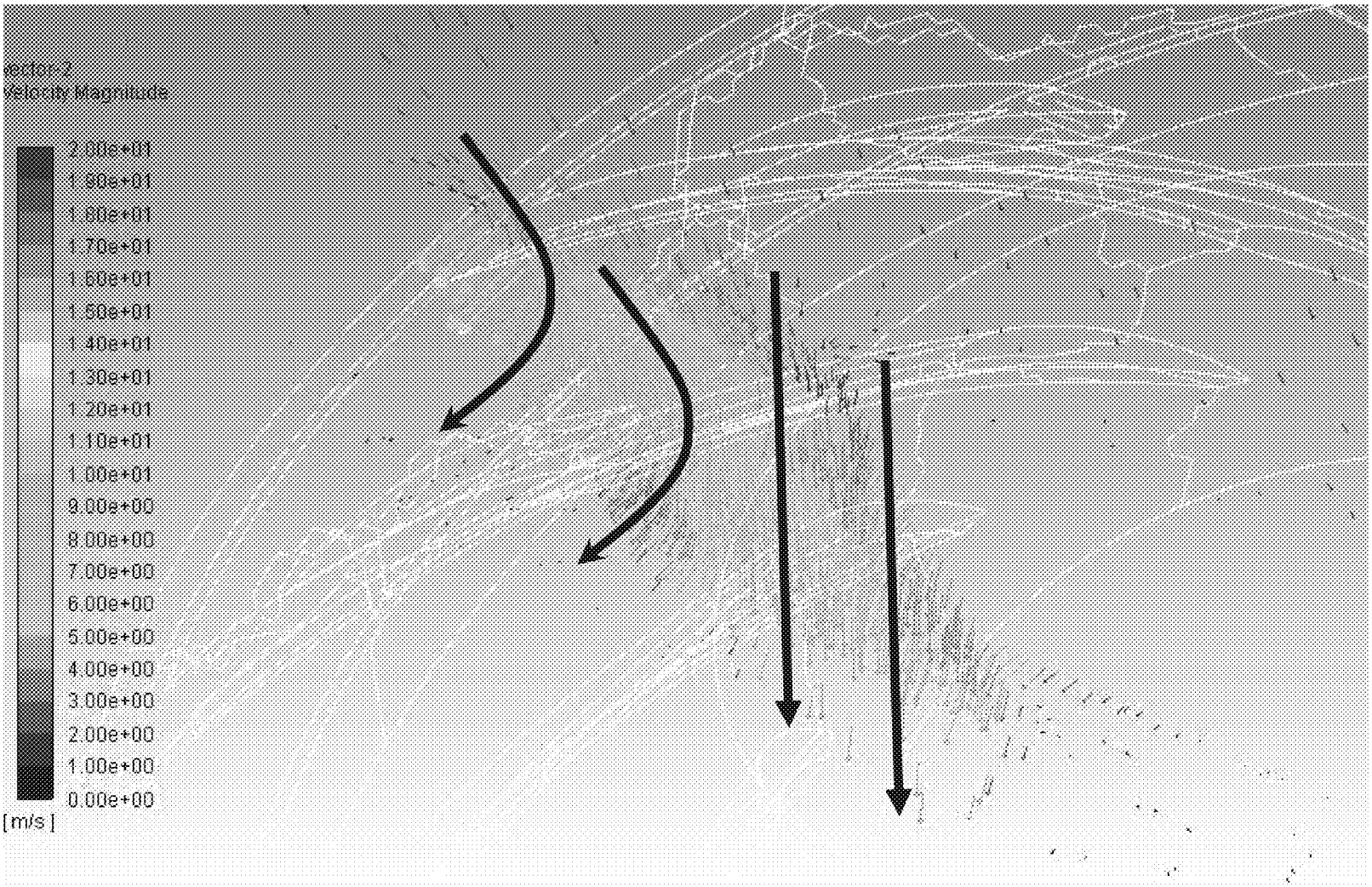
FIG. 7 is a schematic view showing a simulation analysis result of air flows in a wireframe model of the blade structure with the multiple blade angles and the heat dissipation device according to the present disclosure.

Please refer to FIG. 6 to FIG. 7, where FIG. 6 is a schematic view showing a simulation analysis result of air flows in a model of the blade structure with the multiple blade angles and the heat dissipation device according to the present disclosure, and FIG. 7 is a schematic view showing a simulation analysis result of air flows in a wireframe model of the blade structure with the multiple blade angles and the heat dissipation device according to the present disclosure. As shown in FIG. 6 to FIG. 7, according to the result of the simulation analysis of air flows in the flow field of the blade structures by the simulation analysis software, the flow direction caused by the inner blade is different from the flow direction caused by the outer blade, and two obviously different air flow directions are shown. Therefore, the different blade angles of the blades on the fan can redirect air flows by multi-angles, multi-directions, and multi-gradations guiding. The blade angles A1 and A2 of the blades 210 and 220 according to the present disclosure decrease from the inner sides to the outer sides of the blade structures 20 along the longitudinal directions of the blade structures 20, such that shedding air flow occurred on the blade surfaces during the operation of the fan is reduced, backflow on the blade surfaces that flows in the opposite direction to the main air flows is suppressed, and vortex turbulence in the flow field is reduced, thereby increasing the air volume and improving the heat dissipation efficiency. The closer the blades are located to the outer sides of the blade structures 20, the smaller the blade angles of the blades are, reducing vortices and vortex shedding at the outer sides of the blade structures 20 and reducing pressure pulsation at the outer sides of the blade structures 20 and thus reducing vortex noise and vibration.

As discussed above, the blade structure with different blade angles and the heat dissipation device according to the present disclosure have simple structure, reasonable design, and high practicability. Through the design that the blade structure is a set of the blades with different blade angles, the blade structures can guide air flow in a way of multiple angles, multiple directions, and multiple gradations while rotating, reducing the air shedding occurred on the blade surfaces, suppressing vortex turbulence in the flow field, increasing air volume, improving heat dissipation efficiency, and reducing vortex noise and vibration.

The embodiments are chosen and described in order to best explain the principles of the present disclosure and its practical applications, to thereby enable others skilled in the art best utilize the present disclosure and various embodiments with various modifications as are suited to the particular use being contemplated. It is intended that the scope of the present disclosure is defined by the following claims and their equivalents.

What is claimed is:

1. A blade structure with multiple blade angles, wherein the blade structure has a leading edge and a trailing edge that are opposite to each other, the blade structure consists of a plurality of blades with different blade angles, a joint between the plurality of blades of the blade structure is located at the leading edge of the blade structure, and each of the plurality of blades extends from the leading edge to the trailing edge.

2. The blade structure according to claim 1, wherein the blade angles of the plurality of blades decrease from an inner side to an outer side of the blade structure along a longitudinal direction of the blade structure.

3. The blade structure according to claim 1, wherein the plurality of blades have top portions that are located on a same surface.

4. The blade structure according to claim 3, wherein the plurality of blades are integrally formed in one piece.

5. A heat dissipation device, comprising:

a hub; and a plurality of blade structures, evenly mounted on the hub, wherein each of the plurality of blade structures has a leading edge and a trailing edge that are opposite to each other, the plurality of blade structures consist of a plurality of blades with different blade angles, a joint between the plurality of blades of each of the plurality of blade structures is located at the leading edge of each of the plurality of blade structures, and each of the plurality of blades of each of the plurality of blade structures extends from the leading edge to the trailing edge thereof.

6. The heat dissipation device according to claim 5, wherein the blade angles of the plurality of blades decrease from inner sides to outer sides of the plurality of blade structures along longitudinal directions of the plurality of blade structures.

7. The heat dissipation device according to claim 5, wherein the plurality of blades of each of the plurality of blade structures have top portions that are located on a same surface.

8. The heat dissipation device according to claim 7, wherein the plurality of blades of each of the plurality of blade structures are integrally formed in one piece.

9. The heat dissipation device according to claim 5, further comprising an outer frame, wherein blades of the plurality of blades located at outermost sides of the plurality of blade structures are connected to the outer frame.

10. The heat dissipation device according to claim 9, wherein the hub and the plurality of blade structures are integrally formed in one piece, or the hub, the plurality of blade structures, and the outer frame are integrally formed in one piece.

11. A heat dissipation device, comprising:

a hub; and a plurality of blade structures, evenly mounted on the hub, wherein each of the plurality of blade structures has a leading edge and a trailing edge that are opposite to each other, the plurality of blade structures consist of a plurality of blades with different blade angles, a joint between the plurality of blades of each of the plurality of blade structures is located at the leading edge of each of the plurality of blade structures, and there is an opening located between the plurality of blades along a longitudinal direction of each of the plurality of blade structures.

12. A heat dissipation device, comprising:

a hub; and a plurality of blade structures, evenly mounted on the hub, wherein each of the plurality of blade structures has a leading edge and a trailing edge that are opposite to each other, the plurality of blade structures consist of a plurality of blades with different blade angles, a joint between the plurality of blades of each of the plurality of blade structures is located at the leading edge of each of the plurality of blade structures, and each of the plurality of blade structures has an opening extending along a direction from the leading edge to the trailing edge thereof and dividing the corresponding blade structure into the plurality of blades at two opposite sides of the opening.

* * * * *